US009750288B2

(12) United States Patent
Gehlhausen

(10) Patent No.: US 9,750,288 B2
(45) Date of Patent: Sep. 5, 2017

(54) BACKLESS SUPPORT BRA

(71) Applicant: SEXY BACK BRA, LLC, Whitefish, MT (US)

(72) Inventor: Gordana Gehlhausen, Playa del Rey, CA (US)

(73) Assignee: SEXY BACK BRA, LLC, Whitefish, MT (US)

( * ) Notice: Subject to any disclaimer, the term of this patent is extended or adjusted under 35 U.S.C. 154(b) by 0 days.

(21) Appl. No.: 14/809,073

(22) Filed: Jul. 24, 2015

(65) Prior Publication Data

US 2017/0020204 A1 Jan. 26, 2017

(51) Int. Cl.

| | |
|---|---|
| ***A41C 3/00*** | (2006.01) |
| ***A41C 1/06*** | (2006.01) |
| *A41B 9/00* | (2006.01) |
| *A41B 9/08* | (2006.01) |

(52) U.S. Cl.

CPC ..... *A41C 3/0078* (2013.01); *A41C 1/06* (2013.01); *A41B 9/002* (2013.01); *A41B 9/08* (2013.01); *A41C 3/00* (2013.01)

(58) Field of Classification Search

CPC ..... A41C 3/0078; A41C 1/006; A41C 1/08; A41C 1/06; A41C 3/00; A41F 1/006; A41F 18/00; A41F 19/00; A41B 9/08; A41B 9/04; A41B 9/002

USPC .... 450/2, 6, 7, 8, 14, 16, 22, 27–28, 33, 96, 450/106, 113, 3–5, 1, 9–13, 29, 64, 155; D2/708, 701, 709; 2/67; 128/95.1, 98.1

See application file for complete search history.

(56) References Cited

U.S. PATENT DOCUMENTS 298,067 A * 5/1884 Clarke ..... A41C 3/00 450/84
463,050 A * 11/1891 Harvey ..... A41C 3/00 450/29
561,427 A * 6/1896 McKay ..... A41B 13/08 2/112
751,641 A * 2/1904 Hazelbaker ..... A41C 1/00 450/107
839,699 A * 12/1906 Anderson ..... A41D 7/00 2/67

(Continued)

FOREIGN PATENT DOCUMENTS

| | | | |
|---|---|---|---|
| CH | 179421 A | * | 9/1935 |
| CH | 239201 A | * | 9/1945 |
| DE | 333705 | * | 3/1921 |
| FR | 378041 A | * | 9/1907 |
| FR | 765468 | * | 6/1934 |

(Continued)

OTHER PUBLICATIONS

Simply Fab: Maidenform Breakthrough Backless Bra posted at popsugar.com earliest date available Apr. 9 2008 [online] acquired on Mar. 14, 2016. Available from Internet <URL: http:www.popsugar.comfashionSimply-Fab-Maidenform-Breakthrough-Backless-Bra-1506218>.

(Continued)

*Primary Examiner* — Gloria Hale
*Assistant Examiner* — Brieanna Szafran
(74) *Attorney, Agent, or Firm* — Cowan, Liebowitz & Latman, P.C.; Mark Montague

(57) ABSTRACT

A backless support bra having a front main portion with first and second upper shoulder straps and first and second lower pelvic straps, which are designed to pass through the pelvic region of a wearer, securing the bra in place and providing support to the wearer without exposing bra wings in the back region of the wearer. Various methods of securing the backless support bra are also provided.

12 Claims, 7 Drawing Sheets

(56) References Cited

U.S. PATENT DOCUMENTS

| | | | | | |
|---|---|---|---|---|---|
| 862,170 | A * | 8/1907 | Kellogg | A41C 3/00 | 450/29 |
| 880,444 | A * | 2/1908 | Donaldson | A41C 1/00 | 450/106 |
| 959,441 | A * | 5/1910 | Anderson | A41D 7/00 | 2/113 |
| 1,033,788 | A | 7/1912 | Dennis | | |
| 1,060,329 | A * | 4/1913 | Feldman | A41C 3/00 | 2/110 |
| 1,067,289 | A * | 7/1913 | Volk | A41C 3/00 | 450/61 |
| 1,205,758 | A * | 11/1916 | Leeman | A41C 3/00 | 450/29 |
| 1,434,231 | A * | 10/1922 | Sherry | A41C 1/06 | 450/28 |
| 1,522,658 | A * | 1/1925 | Voorhees | A41B 13/08 | 2/109 |
| 1,562,128 | A * | 11/1925 | Stanley | A41C 3/00 | 2/305 |
| 1,649,736 | A * | 11/1927 | Rosenthal | A41C 3/00 | 450/29 |
| 1,762,399 | A * | 6/1930 | Kops | A41C 1/06 | 450/16 |
| 1,797,022 | A * | 3/1931 | Reinohl | A41C 1/06 | 450/112 |
| 1,831,607 | A * | 11/1931 | Reese | A41C 3/08 | 2/44 |
| 1,840,937 | A * | 1/1932 | Duff | A41C 1/06 | 450/16 |
| 1,955,523 | A * | 4/1934 | Yerkes | A41C 3/00 | 450/1 |
| 1,962,984 | A * | 6/1934 | Crego | A41D 7/00 | 2/67 |
| 2,057,224 | A * | 10/1936 | Barley | A41C 3/00 | 450/84 |
| 2,118,406 | A * | 5/1938 | Klin | A41F 1/006 | 450/28 |
| 2,126,591 | A * | 8/1938 | Voss | A41C 3/00 | 450/13 |
| 2,127,927 | A * | 8/1938 | McCabe | A41C 3/00 | 450/36 |
| 2,248,204 | A * | 7/1941 | Snider | A41C 3/124 | 450/114 |
| 2,315,930 | A * | 4/1943 | Burke | A41F 11/02 | 450/27 |
| 2,351,680 | A * | 6/1944 | Hatton | A41C 3/00 | 450/84 |
| 2,352,367 | A * | 6/1944 | Bujdossy | A41C 3/00 | 450/84 |
| 2,397,710 | A * | 4/1946 | Versoy | B64D 10/00 | 450/94 |
| D151,742 | S | 11/1948 | Daché | | |
| 2,475,893 | A * | 7/1949 | Hayes | A41C 3/00 | 450/64 |
| 2,490,351 | A * | 12/1949 | Gradara | A41C 3/00 | 2/306 |
| 2,542,881 | A | 2/1951 | Ries | | |
| 2,719,568 | A * | 10/1955 | Webb | A61H 3/008 | 2/69 |
| 2,779,943 | A * | 2/1957 | Kelleher | A41C 3/148 | 623/7 |
| 2,895,480 | A * | 7/1959 | Fixel | A41F 11/00 | 450/111 |
| 2,918,920 | A * | 12/1959 | Lutsky | A61F 5/03 | 450/2 |
| 3,077,885 | A * | 2/1963 | Hopper | A41C 3/0078 | 450/86 |
| 3,109,431 | A | 11/1963 | Jefferson | | |
| 3,216,425 | A * | 11/1965 | Keersmaecker | A41C 3/0078 | 2/67 |
| 3,411,508 | A * | 11/1968 | Sayers | A41C 3/0078 | 450/27 |
| 3,465,754 | A * | 9/1969 | Lockwood | A41C 3/00 | 450/1 |
| 3,939,845 | A | 2/1976 | Guidoni | | |
| 3,982,547 | A | 9/1976 | Walker | | |
| D249,096 | S * | 8/1978 | Fowler | D2/731 | |
| 4,191,192 | A * | 3/1980 | McDavid | A41C 3/0057 | 450/33 |
| 4,418,696 | A | 12/1983 | Delet | | |
| 4,815,145 | A | 3/1989 | Chow | | |
| D300,880 | S | 5/1989 | Mathis | | |
| 4,983,140 | A | 1/1991 | Gimble | | |
| 5,120,264 | A * | 6/1992 | Van Engel | A41B 9/002 | 2/67 |
| 5,162,015 | A * | 11/1992 | Otani | A41B 9/08 | 2/109 |
| 5,884,340 | A * | 3/1999 | Chen | A41D 7/006 | 2/267 |
| 6,009,556 | A * | 1/2000 | Nenninger | A41D 7/00 | 2/301 |
| 6,173,449 | B1 * | 1/2001 | Osterrath | A41D 7/00 | 2/1 |
| D453,604 | S | 2/2002 | Hart | | |
| 6,397,391 | B2 | 6/2002 | DeMarco | | |
| 6,547,636 | B1 | 4/2003 | Cato | | |
| 6,817,038 | B2 | 11/2004 | Blanco | | |
| D562,528 | S * | 2/2008 | Deal | D2/700 | |
| D579,177 | S | 10/2008 | Paul | | |
| D587,878 | S | 3/2009 | Higo et al. | | |
| 7,572,167 | B2 * | 8/2009 | Cheng | A41C 1/06 | 450/6 |
| 7,607,964 | B2 | 10/2009 | Mone et al. | | |
| D604,476 | S | 11/2009 | Allen et al. | | |
| D625,487 | S | 10/2010 | Hendrickson | | |
| D625,488 | S | 10/2010 | Messman et al. | | |
| D626,308 | S | 11/2010 | DiGeronimo | | |
| D629,587 | S | 12/2010 | Tena | | |
| D709,670 | S | 7/2014 | Vericella | | |
| D731,745 | S | 6/2015 | Maragni | | |
| D733,994 | S | 7/2015 | Hays et al. | | |
| D734,591 | S | 7/2015 | Jirsa | | |
| D741,566 | S | 10/2015 | Perry et al. | | |
| D748,371 | S | 2/2016 | Oliver | | |
| D756,066 | S | 5/2016 | Lorie | | |
| D762,944 | S | 8/2016 | Gehlhausen | | |
| D763,545 | S | 8/2016 | Morin | | |
| 2003/0187323 | A1 * | 10/2003 | Goodman | A41B 9/002 | 600/38 |
| 2005/0064790 | A1 * | 3/2005 | Mone | A41C 1/06 | 450/7 |
| 2006/0039165 | A1 * | 2/2006 | Harris | A41D 7/00 | 362/605 |
| 2007/0236916 | A1 | 10/2007 | Hsu | | |
| 2010/0192285 | A1 * | 8/2010 | Ahn | A41B 11/14 | 2/409 |
| 2012/0156962 | A1 * | 6/2012 | Krawchuk | A41B 9/00 | 450/92 |
| 2013/0183885 | A1 | 7/2013 | Yamazaki et al. | | |
| 2016/0338419 | A1 * | 11/2016 | Fayad | A41C 3/0028 | |

FOREIGN PATENT DOCUMENTS

| | | | |
|---|---|---|---|
| GB | 182032 | * | 6/1922 |
| GB | 311217 A | * | 5/1929 |
| GB | 323650 | * | 1/1930 |
| GB | 428783 | * | 5/1935 |
| JP | 2001020104 | * | 1/2001 |

OTHER PUBLICATIONS

The above U.S. Patents 7 and 8 were cited in the International Search Report of the corresponding International Application, PCT/US2016/046050 dated May 18, 2017.

* cited by examiner

BACKLESS SUPPORT BRA

BACKGROUND OF THE INVENTION

Traditional women's undergarments, namely brassieres, generally have a front portion with supportive cups, wings extending from the front portion surrounding the wearer's ribcage, a hook and eye closure to connect the two wings, and two shoulder straps. While traditional bras are practical for everyday use under daily wear, such as t-shirt, blouses, sweaters, etc., these traditional bras are not suitable for all purposes, e.g., for wear with backless garments such as formal gowns.

One solution has been a strapless and backless bra as disclosed in U.S. Pat. No. 6,397,391. While there are no wings of the bra to be exposed under a backless garment, this configuration provides little support to the breasts, resulting in an undesirable appearance. There have been other attempts to solve this problem but with little success.

SUMMARY OF THE INVENTION

Accordingly, a backless support bra comprising: a front main portion having first and second cups, first and second upper shoulder straps each having first and second ends connected to said front main portion, and first and second lower pelvic straps each having first and second ends connected to said front main portion; and wherein said first and second lower pelvic straps are designed to be worn through the pelvic region of a wearer is generally disclosed.

Moreover, a method of securing a backless support bra having a front main portion on a wearer comprising the steps of: sliding upper shoulder straps extending from the front main portion of the backless support bra over the wearer's shoulders; pulling one end of lower pelvic straps extending from the front main portion of the backless support bra through the pelvic region of the wearer; and securing said one end of said lower pelvic straps extending from the front main portion of the backless support bra to the front main portion is also disclosed.

An alternate method of securing a backless support bra having a front main portion on a wearer comprising the steps of: sliding upper shoulder straps extending from the front main portion of the backless support bra over the wearer's shoulders; crisscrossing lower pelvic straps extending from the front main portion of the backless support bra in a torso region of the wearer; pulling said lower pelvic straps around the hip region of the wearer; pulling said lower pelvic straps through the pelvic region of the wearer; and securing a distal end of said lower pelvic straps onto said lower pelvic straps is also described.

BRIEF DESCRIPTION OF THE DRAWINGS

A more complete understanding of the present invention may be obtained by reference to the Detailed Description when taken in conjunction with the accompanying Drawings.

DETAILED DESCRIPTION OF THE INVENTION

Figure 1:
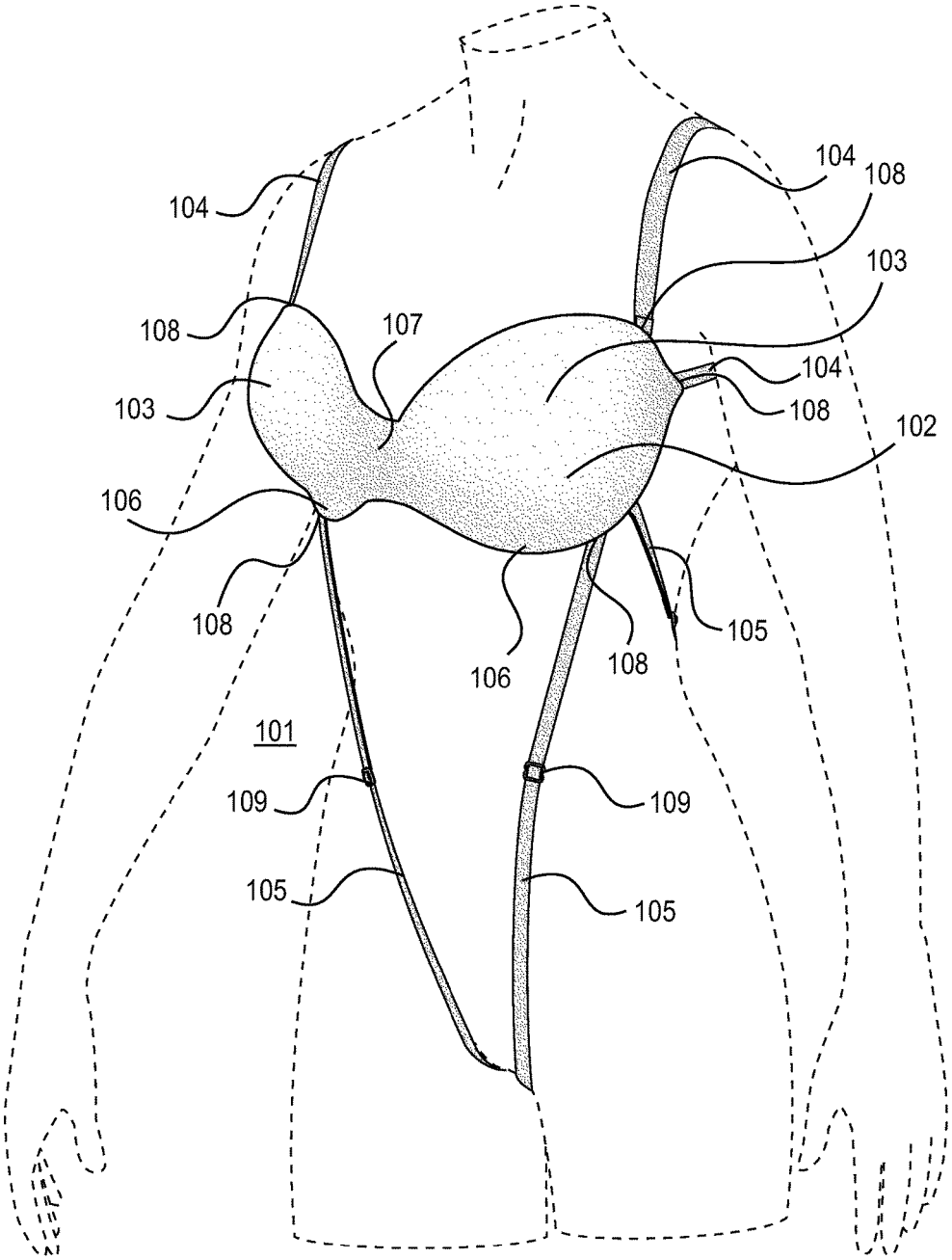
FIG. 1 is a front perspective view of a backless support bra in accordance with one aspect of the present invention.
Figure 2:
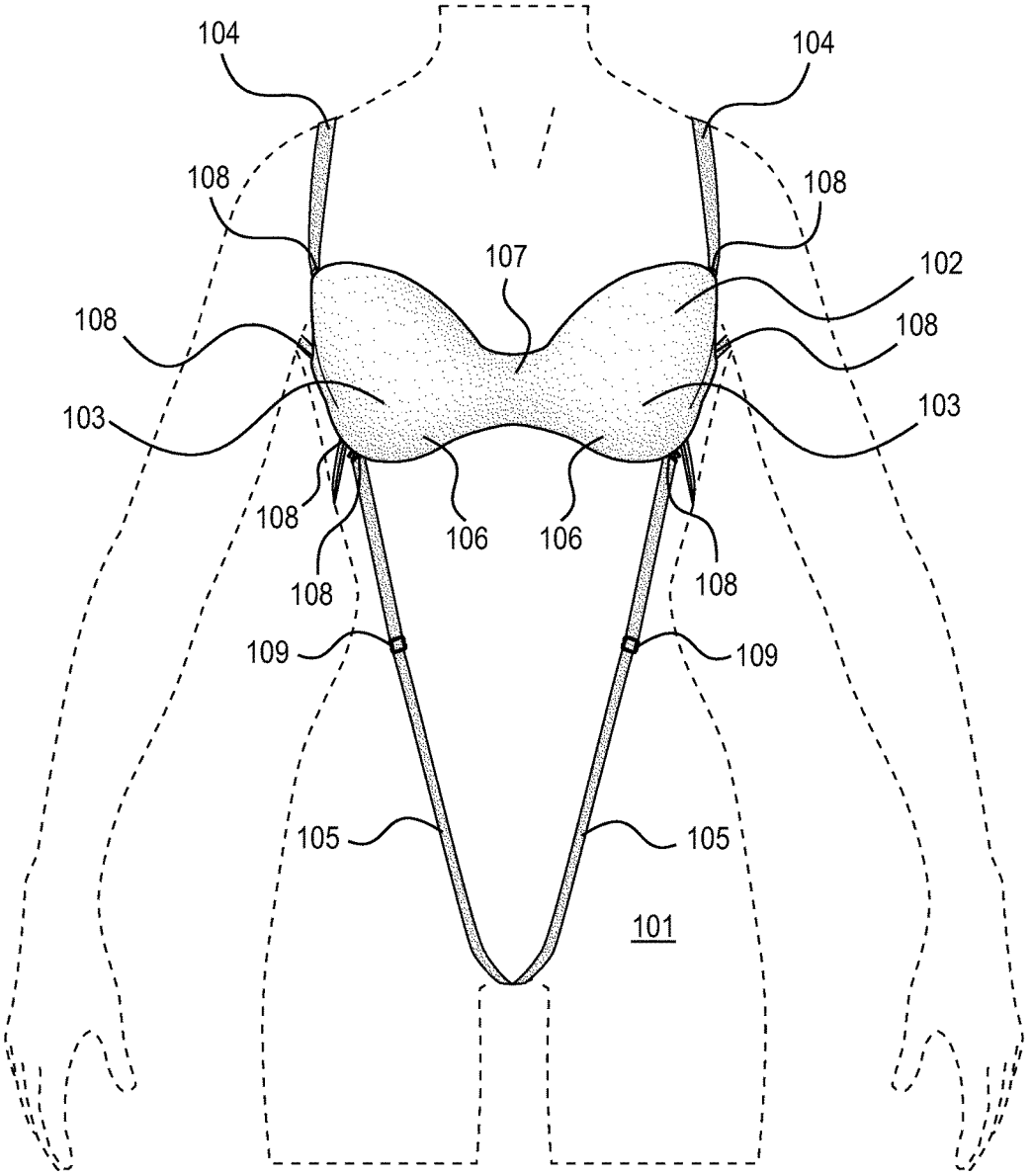
FIG. 2 is a front view of the backless support bra seen in FIG. 1.

Turning now to the figures, FIGS. 1-5 show front, rear, and side views of a backless support bra 101 in accordance with one aspect of the present invention. Backless support bra 101 has a front main portion 102 having first and second cups 103. Backless support bra 101 has first and second upper shoulder straps 104, which are designed to go over the shoulders of a wearer. Backless support bra 101 also has first and second lower pelvic straps 105 that extend from the front main portion 102, and pass through the pelvic area of a user to reattach at the front main portion 102.

Cups 103 can be lined, padded, or otherwise enhanced to provide additional support and/or enhancement. Cups 103 can be of various sizes ranging from AAA-N. These cup variations would be understood to those having ordinary skill in the art and such variations would not serve to limit the scope of the invention. In addition to cups 103, front main portion 102 can also include channels having underwire 106 underneath the cups 103 to provide additional support and lift to the wearer's breasts. A center front gore 107 generally connects cups 103.

Both upper shoulder straps 104 and lower pelvic straps 105 attach to front main portion 102 at hook points 108. Hook points 108 generally comprise of a bra hook (not visible in every figure but can be seen in FIG. 6 at reference number 110) and an eye found on the inside of front main portion 102. A plurality of eyes (not visible in figures) are provided on the inside and along the edge of front main portion 102 to allow the hooks found on the end of the upper shoulder straps 104 and lower pelvic straps 105 to attach at various locations along the edge of the front main portion 102. At least three eyes, but preferably four or more, would be provided to allow for the straps 104 and 105 to attach the front main portion 102.

It should be understood that hook points can be more permanently affixed, for example, by sewing the two portion together. This may be used where regular attachment and detachment of a hook from an eye for removal of the bra is not necessary. For example, hook points 108 on shoulder strap 104 could be more permanently affixed since the shoulder straps 104 can be slid over the arms.

Sliders 109 can also placed along uppers shoulder straps 104 and lower pelvic straps 105 to adjust the length of the straps to fit various body sizes and types.

The neckline created by the cups 103 of the front main portion 102 can be a variety of shapes as would be understood to those having skill in the art. In these exemplary figures, the neckline is shown to be contoured or molded, but the front main portion 102 and cups 103 could be in plunge, full-cup, demi-cup, push-up, balconette, or shelf styles, for example. These cups can be made from a variety of materials, sizes, and colors known in the art of bra-making. The upper shoulder straps 104 and lower pelvic straps 105 can be a variety of widths and made from a variety of materials and in a variety of colors.

Figure 3:
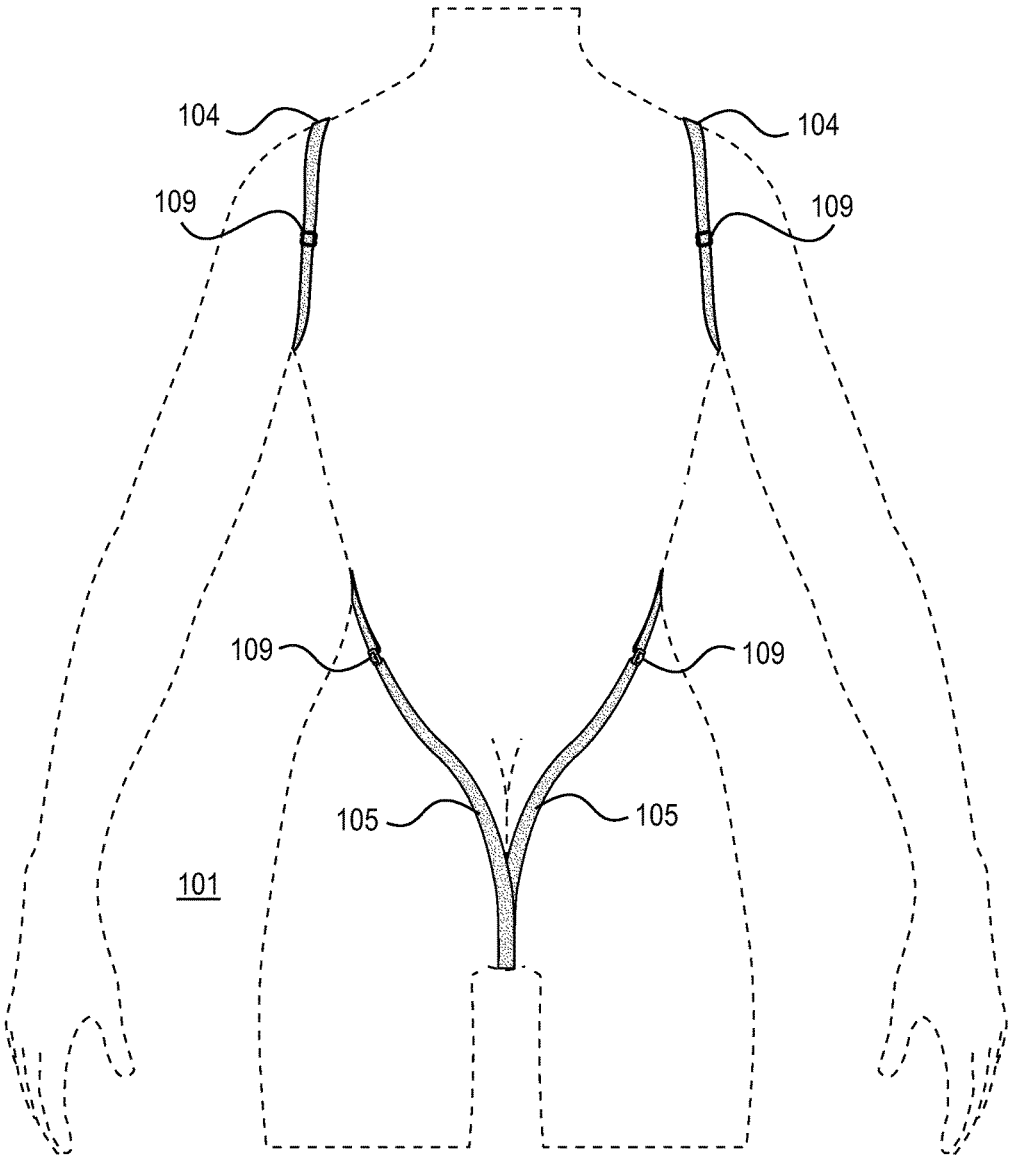
FIG. 3 is a rear view of the backless support bra seen in FIG. 1.
Figure 4:
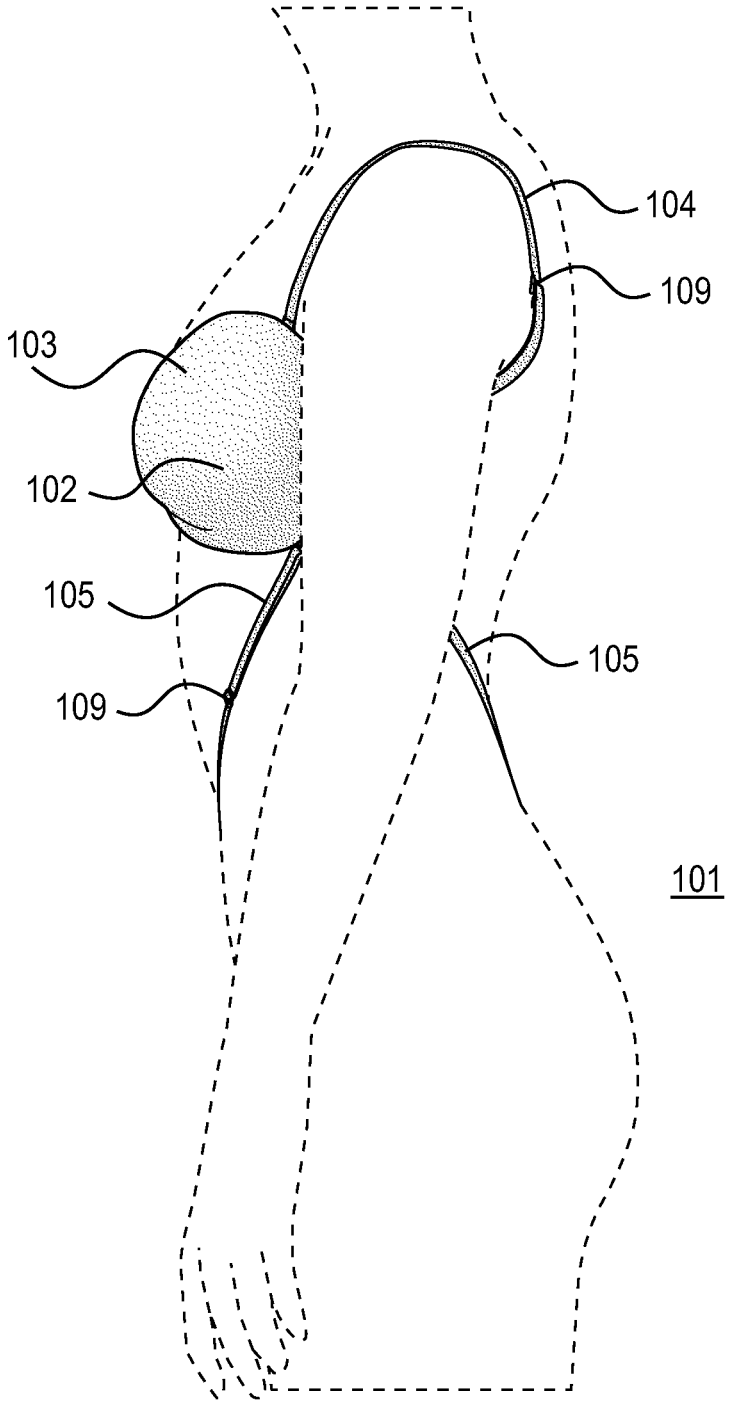
FIG. 4 is a left side view of the backless support bra seen in FIG. 1.
Figure 5:
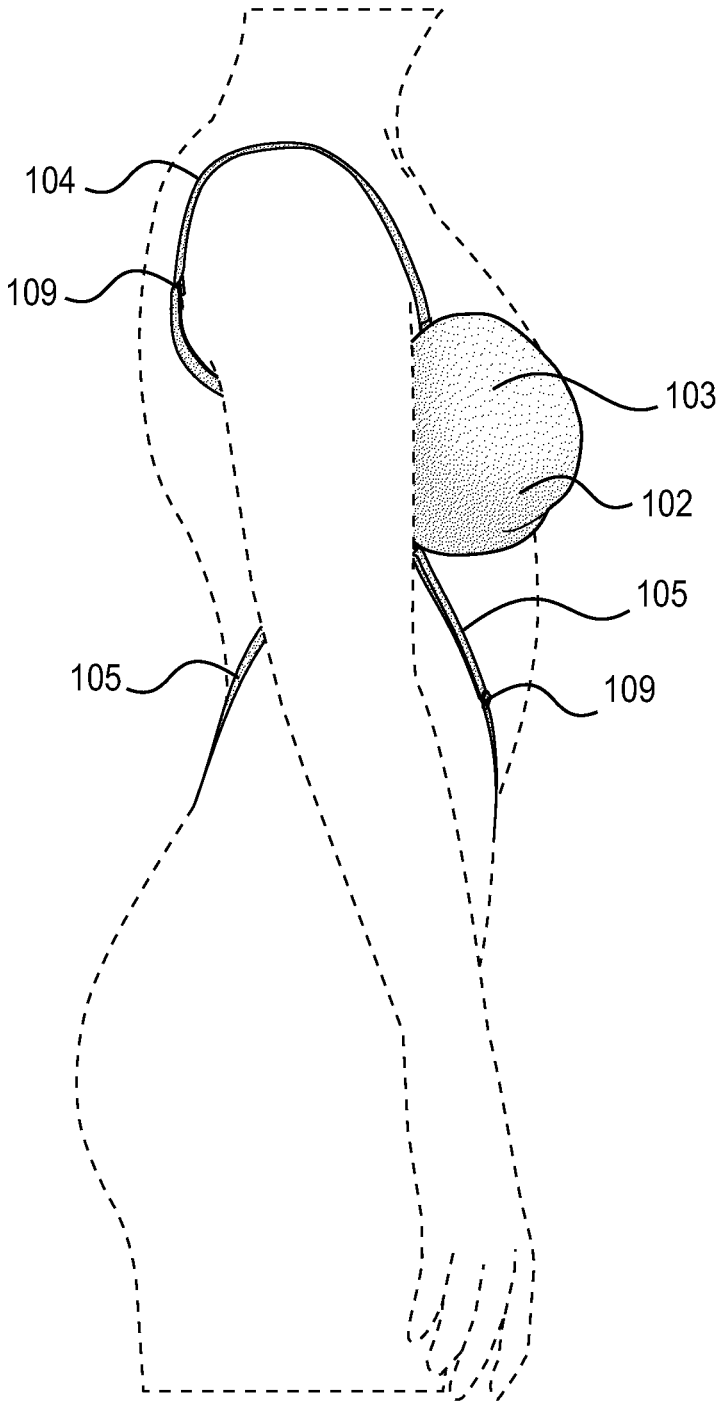
FIG. 5 is a right side view of the backless support bra seen in FIG. 1.
Figure 7:
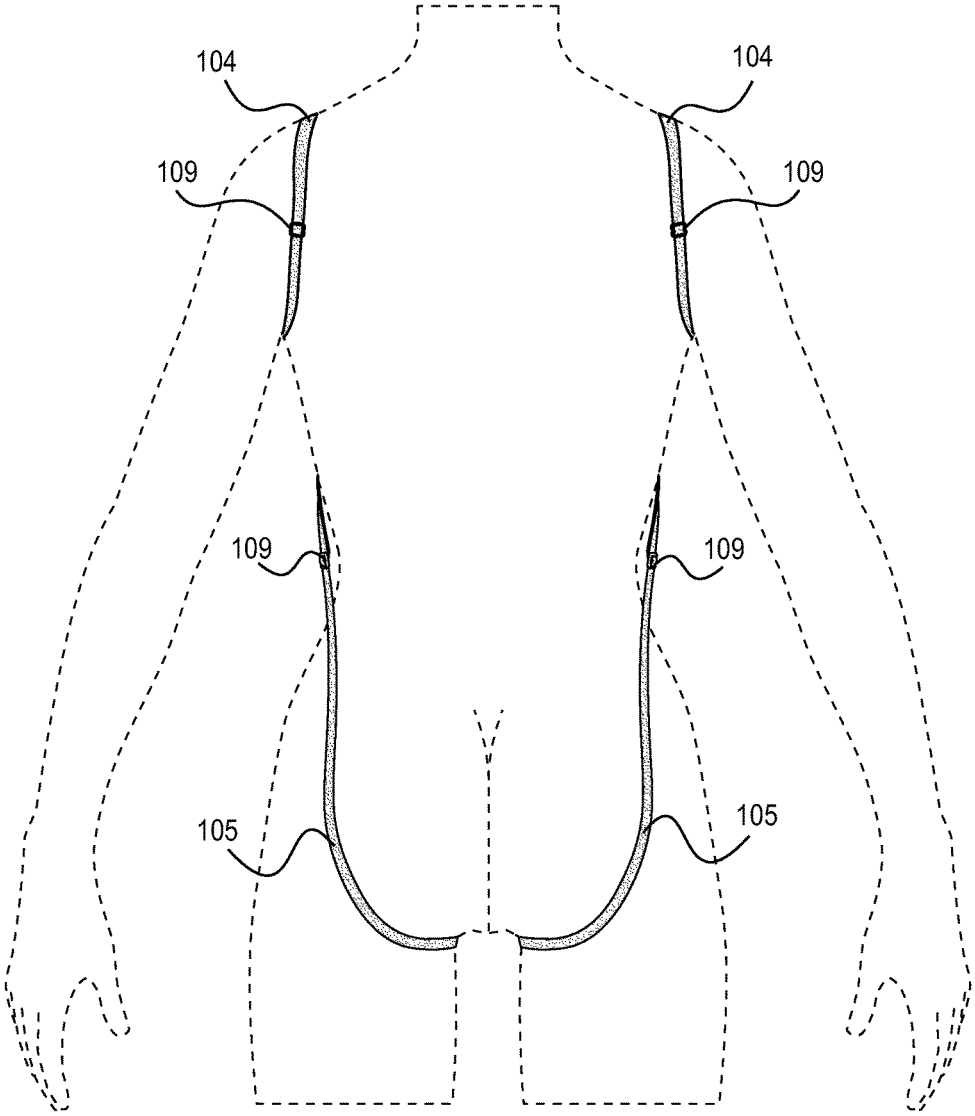
FIG. 7 is the rear view of an alternate embodiment of the backless support bra in accordance with one aspect of the present invention.

As shown FIG. 3, pelvic straps 105 can be worn between a wearer's buttocks in a thong-style, to avoid panty lines. Alternately, the pelvic straps 105 can be worn along a full-coverage panty line as can generally be seen in FIG. 7.

Figure 6:
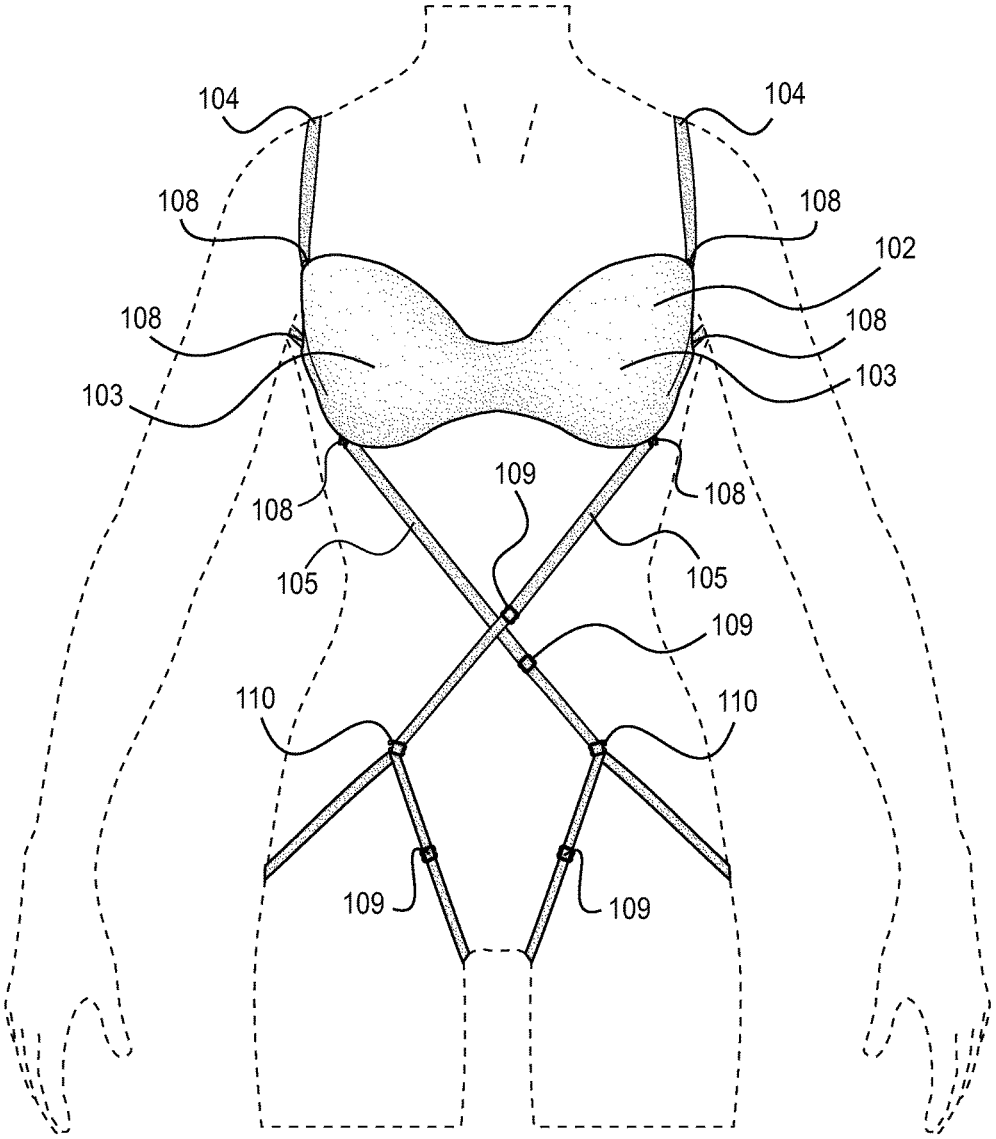
FIG. 6 is a front view of an alternate embodiment of the backless support bra in accordance with one aspect of the present invention.

Turning now to FIG. 6, shown in this figure is an alternate way to use pelvic straps 105. In this configuration, lower pelvic straps 105 are crisscrossed in front of the body of the wearer, pulled around the hip region of the wearer, and then through the pelvic region from back-to-front to reattach to the lower pelvic straps 105 in the front body portion of the user using hooks 110. Sliders 109 can be used to adjust the length of the lower pelvic straps 105 to accommodate the wearer.

While the foregoing written description of the invention enables one of ordinary skill in the art to make and use the invention, those of ordinary skill in the art will understand and appreciate the existence of variations, combination, and equivalents of the embodiments, methods, and examples provided herein. The invention should, therefore, not be limited by the embodiments and examples disclosed here, but by all embodiments and methods within the scope and spirit of the invention as claimed.

What is claimed is:

1. A backless support bra comprising:

a front main portion having first and second cups;

first and second upper shoulder straps each having first and second ends connected to said front main portion; and first and second lower pelvic straps each having first and second ends, each of said first and second ends of said first and second lower pelvic straps being connected to said front main portion;

each of said first and second lower pelvic straps designed to, when the backless support bra is worn by a wearer, extend downward from the front main portion, through a pelvic region of the wearer, to in-between a buttocks of the wearer, and then extend upward back up to the front main portion, wherein both of the first and second ends of said first and second lower pelvic straps are directly connected to a respective one of the first and second cups of the front main portion by attachment points.

2. The backless support bra of claim 1, wherein said attachment points are at least three hook points for removably attaching said first and second upper shoulder straps and attaching at least one of said first and second ends of said first and second lower pelvic straps to the first and second cups.

3. The backless support bra of claim 1, wherein said front main portion has at least one hook point as one of the attachment points for removably attaching one of said first and second ends of said first and second lower pelvic straps.

4. The backless support bra of claim 1, wherein said first and second upper shoulder straps are permanently affixed to said front main portion.

5. The backless support bra of claim 1, wherein sliders are provided along said first and second lower pelvic straps.

6. The backless support bra of claim 1, wherein said first and second upper shoulder straps each having first and second ends connected directly to said at least one of the first and second cups of the front main portion.

7. The backless support bra of claim 1, wherein at least one of the first and second ends of the first and second lower pelvic straps are permanently affixed to a respective one of the first and second cups of the front main portion.

8. A backless support bra comprising:

a front main portion having first and second cups;

first and second upper shoulder straps each having first and second ends connected to said front main portion; and first and second lower pelvic straps each having first and second ends, wherein both of the first and second ends of said first and second lower pelvic straps are directly connected to a respective one of the first and second cups of the front main portion by attachment points in a first wearing configuration;

the first wearing configuration comprising:

wherein each of said first and second lower pelvic straps are designed to, when the backless support bra is worn by a wearer, extend downwardly from the front main portion, through a pelvic region of a wearer, to in-between a buttocks of the wearer, and then extend upward back up to the front main portion;

further wherein each of said first and second lower pelvic straps can be moved into an alternate, second wearing configuration from the first wearing configuration, the second wearing configuration comprising:

the first end of said first lower pelvic strap being connected to said front main portion;

the first end of said second lower pelvic strap being connected to said front main portion;

the second end of said first lower pelvic strap being connectable to a front body portion of said first lower pelvic strap; and the second end of said second lower pelvic strap being connectable to a front body portion of said second lower pelvic strap.

9. The backless support bra of claim 8, wherein said front main portion has two hook points for removably attaching said first and second upper shoulder straps.

10. The backless support bra of claim 8, wherein said first and second upper shoulder straps are permanently affixed to said front main portion.

11. The backless support bra of claim 8, wherein in the second configuration:

said second end of said first lower pelvic strap is connectable to the front body portion of said first lower pelvic strap by a first hook;

and said second end of said second lower pelvic strap is connectable to the front body portion of said second lower pelvic strap by a second hook.

12. The backless support bra of claim 8, wherein said first and second upper shoulder straps each having first and second ends connected directly to said at least one of the first and second cups of the front main portion.

* * * * *